US010905244B2

(12) United States Patent
Engell

(10) Patent No.: US 10,905,244 B2
(45) Date of Patent: Feb. 2, 2021

(54) BALANCE CHAIR

(71) Applicant: Maria Terese Engell, Grue Finnskog (NO)

(72) Inventor: Maria Terese Engell, Grue Finnskog (NO)

( * ) Notice: Subject to any disclaimer, the term of this patent is extended or adjusted under 35 U.S.C. 154(b) by 71 days.

(21) Appl. No.: 16/303,859

(22) PCT Filed: May 24, 2016

(86) PCT No.: PCT/NO2016/050102
§ 371 (c)(1),
(2) Date: Nov. 21, 2018

(87) PCT Pub. No.: WO2017/204648
PCT Pub. Date: Nov. 30, 2017

(65) Prior Publication Data

US 2020/0163462 A1 May 28, 2020

(51) Int. Cl.

| | |
|---|---|
| ***A47C 3/025*** | (2006.01) |
| ***A47C 3/026*** | (2006.01) |
| ***A47C 3/18*** | (2006.01) |
| ***A47C 3/20*** | (2006.01) |
| ***A47C 3/22*** | (2006.01) |
| ***A47C 9/02*** | (2006.01) |
| ***A47C 9/00*** | (2006.01) |
| ***A47C 1/00*** | (2006.01) |
| ***A63B 21/00*** | (2006.01) |

(Continued)

(52) U.S. Cl.

CPC ..... *A47C 9/002* (2013.01); *A47C 1/00* (2013.01); *A47C 3/026* (2013.01); *A47C 3/0255* (2013.01); *A47C 3/18* (2013.01); *A63B 21/00069* (2013.01); *A63B 21/023* (2013.01); *A63B 21/0407* (2013.01); *A63B 21/0552* (2013.01); *A63B 23/0205* (2013.01); *A63B 26/003* (2013.01); *A63B 69/04* (2013.01); *A63B 2208/0233* (2013.01); *A63B 2225/093* (2013.01); *A63B 2244/24* (2013.01)

(58) Field of Classification Search

CPC ..... A47C 1/00; A47C 3/0255; A47C 3/026; A47C 3/18; A47C 9/002
USPC ..... 297/314, 461, 423.38, 195.11
See application file for complete search history.

(56) References Cited

U.S. PATENT DOCUMENTS

| | | | |
|---|---|---|---|
| 849,975 | A | 4/1907 | Carlson |
| 3,103,356 | A | 9/1963 | Heines |

(Continued)

FOREIGN PATENT DOCUMENTS

| | | | |
|---|---|---|---|
| DE | 19504121 | A1 | 8/1996 |
| EP | 0586675 | B1 | 1/2001 |

(Continued)

OTHER PUBLICATIONS

Mortensen, Tatiana P., "International Search Report" for PCT/NO2016/050102, dated Dec. 12, 2016, eight pages.

*Primary Examiner* — Rodney B White
(74) *Attorney, Agent, or Firm* — Shackelford, Bowen, McKinley & Norton, LLP

(57) ABSTRACT

A balance chair, comprising a seat, an in substance vertical height element supporting the seat, and a base supporting the height element and seat, distinctive in that the balance chair comprises a rotation and tilt element, arranged in a position in substance midway between the seat and a lower end of the base.

10 Claims, 2 Drawing Sheets

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 23/02*** | (2006.01) |
| ***A63B 26/00*** | (2006.01) |
| *A63B 69/04* | (2006.01) |

(56) References Cited

U.S. PATENT DOCUMENTS

| | | | | | |
|---|---|---|---|---|---|
| 4,099,697 | A | | 7/1978 | Von Schuckmann | |
| 4,605,334 | A | * | 8/1986 | Kalvatn | A47C 9/002 297/314 X |
| 4,974,904 | A | * | 12/1990 | Phillips | A47C 9/002 297/258.1 |
| 5,524,967 | A | * | 6/1996 | Glockl | A47C 3/02 297/314 X |
| 5,551,753 | A | * | 9/1996 | Glockl | A47C 3/023 297/314 X |
| 5,570,929 | A | | 11/1996 | Glöckl | |
| 5,590,930 | A | * | 1/1997 | Glockl | A47C 3/0257 297/313 X |
| 5,795,078 | A | * | 8/1998 | Li | A47C 3/0257 384/2 |
| 6,003,944 | A | * | 12/1999 | Glockl | A47C 3/18 297/314 X |
| 6,106,064 | A | * | 8/2000 | Hibberd | A47C 3/025 297/314 |
| 6,601,818 | B1 | * | 8/2003 | Larsen | A47C 3/0255 248/158 |
| 6,685,268 | B2 | * | 2/2004 | Meyer | A47C 7/448 297/314 X |
| 7,547,067 | B2 | * | 6/2009 | Keilhauer | A47C 3/02 297/314 X |
| 7,686,396 | B2 | * | 3/2010 | Schaaf | A47C 7/14 297/314 X |
| 7,789,463 | B2 | * | 9/2010 | Gang | A47C 9/002 297/314 X |
| 8,439,442 | B2 | * | 5/2013 | Highlander | A47C 7/14 297/314 X |
| 8,540,314 | B2 | * | 9/2013 | Fernandez | A47C 9/002 297/314 |
| 8,540,519 | B1 | | 9/2013 | Lauter | |
| 9,763,520 | B1 | * | 9/2017 | Pan | A47C 3/0255 |
| 10,034,547 | B1 | * | 7/2018 | Pan | A47C 3/026 |
| 10,362,876 | B2 | * | 7/2019 | Aono | A47C 9/002 |
| 10,433,644 | B2 | * | 10/2019 | Kamiya | A47C 9/00 |
| 2009/0230743 | A1 | * | 9/2009 | Derakhshan | A47C 9/002 297/329 |
| 2012/0126599 | A1 | | 5/2012 | Glockl | |
| 2013/0031712 | A1 | * | 2/2013 | Gossett | A47C 3/34 4/496 |
| 2015/0250317 | A1 | * | 9/2015 | Glockl | A47C 9/002 297/344.12 |
| 2015/0305961 | A1 | * | 10/2015 | Broerman | A47C 9/002 601/115 |
| 2016/0038780 | A1 | * | 2/2016 | Hugou | A47C 3/029 482/8 |
| 2016/0073786 | A1 | * | 3/2016 | Walker | A47C 7/563 297/325 |
| 2016/0331144 | A1 | * | 11/2016 | Murray | A47C 7/566 |
| 2017/0020292 | A1 | * | 1/2017 | Walker | A47C 1/032 |
| 2017/0079441 | A1 | * | 3/2017 | Murray | A47C 9/002 |
| 2018/0317660 | A1 | * | 11/2018 | Marsh | A47C 31/12 |

FOREIGN PATENT DOCUMENTS

| | | | | |
|---|---|---|---|---|
| EP | 1870140 | A1 | 12/2007 | |
| GB | 2230696 | A | 10/1990 | |
| WO | WO-2009123475 | A1 * | 10/2009 | A47C 3/0252 |
| WO | WO-2012068688 | A1 | 5/2012 | |

* cited by examiner

BALANCE CHAIR

FIELD OF THE INVENTION

The present invention relates to a balance chair. More specifically, the invention relates to a chair or device for sitting, having the effect of training balance and core muscles of the user. The balance chair of the invention is particularly useful for training balance and core muscle control for horse riders, providing improved precision and efficiency in training of horse riding skills.

FIELD OF THE INVENTION AND BACKGROUND ART

Numerous chair designs exist, and numerous horse-riding simulators exist. Examples of prior art chairs are the Balimo chair, for extending and training movements of the pelvis, and the BackApp chair. Said chairs are without motors. Other chairs or simulators are with motor or other means for moving or driving, such as the horse like riding simulators seen on Tivoli. The present invention relates to easily movable balance chairs or simulators without motor.

A demand exists for a chair having alternative effect with respect to training of balance and core muscles. A demand also exists for chairs or simulators for precision training of horse riding skills, having improved effect for training balance and having improved effect for training of core muscles.

The objective of the present invention is to meet said demands.

SUMMARY OF THE INVENTION

The invention meets said demands by providing a balance chair, comprising a seat, an in substance vertical height element supporting the seat, and a base supporting the height element and seat, distinctive in that the balance chair comprises a rotation and tilt element, arranged in a position in substance midway between the seat and a lower end of the base.

The rotation and tilt element is preferably arranged in a fixed elevation or position, in substance midway between the seat and the lower end of the base.

Preferably, a part of the rotation and tilt element is arranged to the height element and a part of the rotation and tilt element is arranged to or as a part of an upper part of the base. Accordingly, the rotation and tilt element part of the upper part of the base supports the height element and seat through the rotation and tilt element part of the height element.

Preferably, the rotation and tilt element per se comprises one or more spring or tension elements, providing feasible elastic stiffness or resistance against tilting and/or feasible resistance against rotation. Preferably, the rotation and tilt element comprises a mechanism providing resistance against rotation, such as a friction adjustment bolt.

Preferably, the balance chair comprises separate spring or tension elements acting to provide resistance against tilting and resistance against rotation. Alternatively, spring or tension elements are arranged to both the rotation and tilt element and to or between other structure of the balance chair. Preferably, the balance chair comprises springs or elastic elements arranged between a lower end or part of the height element below the rotation and tilt element and the base element, preferably said elements are arranged radially outwards from the height element. Preferably, said radial spring or tension elements are slideable on the lower part of the height element and includes a fastening bolt or similar for fastening the element in a position providing feasible elasticity. Said elements may include a maximum tilt restriction.

The rotation is coaxial to a longitudinal axis of the height element. The range for rotation is preferably ±180° or ±360°. Alternatively, a rotation restrictor is a part of the balance chair structure.

The tilting is preferably about a fixed point or position, since the rotation and tilt element preferably is at a fixed point or elevation, freely in any direction within the ±360°.

Preferably, the balance chair comprises progressive springs or tension elements or a radial arrangement of linear or progressive spring or tension elements, for providing a progressive resistance to tilting.

In contrast to several prior art balance chairs, it is essential that the major embodiments of the balance chair of the invention is without a motor or a movement guidance structure restricting the basic tilting and rotation functionality. Any movement guidance structure or intermediate tilting restrictor structure are preferably removable or adjustable, in order to allow removal or adjustment thereof as the skill of the balance chair user improve.

The height element, with the seat in an upper end, is supported by the rotation and tilt element. The rotation and tilt element is an operative combination of features arranged to the height element and an upper part of the base, allowing rotation and tilting of the height element and seat whilst the base provides a stable foot for the chair. Accordingly, the seat can tilt about the rotation and tilt element, which rotation and tilt element is about midway between the seat and a floor or under layer to the base, and the seat can rotate around an axis coaxial to a length axis of the height element.

The rotation and tilt element, arranged in a position in substance midway between the seat and a lower end of the base, provides a point of tilting combined with an axis of rotation having different distance from the seat than prior art chairs. Half way between the seat and a lower end of the base, means 0.3 to 0.7 from a top side of a sitting surface face of the seat to the lower and of the base, that is 0.3 to 0.7 from the seat to an underlay, more preferred 0.4 to 0.6, most preferred about 0.5 times the distance from the seat to an underlay.

The tilting is about the rotation and tilt element, about any axis in a xy-plane, assuming z is vertical. The upper part of the balance chair, from the rotation and tilt element and up to and including the seat, preferably is in substance rigid, in contrast to prior art chairs of many types typically having the tilting just below the seat. The effect is a so far unknown precision of balance and core muscle training, for healthy sitting whilst working in for example an office or for more realistic and precise training of riding skills without a horse. The increased momentum arm for tilting and rotation involves control of core muscles and balance in a more realistic way with respect to training for riding, and more fine-tuned to core muscle training and training of balance for office or home use. The position and functionality of the rotation and tilt element result in reaction points and a momentum arm corresponding in substance to the reaction points and momentum arm when riding a horse, as governed by a point of balance and rotation in the chest of a horse. For office use embodiments, the reaction forces for stability are moved towards the core muscles, away from the outer hip muscles.

Horse riders from hobby level to international level confirm the effect of improved balance and training when using the balance chair of the invention. Reduced strain and injury for both horse and rider is the result when the rider has gained improved balance by using the balance chair of the invention when training.

The seat can be like a buck or saddle, for the user to sit on directly or lay a saddle on, which is preferable for balance chairs for training of horse-riding skills. For office use or home use, the balance chair seat preferably has a shape better adapted to a human, such as other office or home seats, and with or without fixed or releasable back and with or without fixed or releasable arm rests.

In a preferable embodiment, the balance chair comprises a height adjustment mechanism, preferably in the height element, for example a telescopic height adjustment mechanism adjusting not only the height of the balance chair but also the height from the seat to the rotation and tilt element. The balance chair may comprise other or additional height adjustment devices.

Preferably, the rotation and tilt element provides 360° rotation around and tilting in any direction about said element. For alternative embodiments, the rotation and tilt element provides 360° rotation around and tilting about only one or two axes about said element.

Preferably, the rotation and tilt element comprises or is operatively arranged to one or more devices providing elasticity for tilting in any direction about said element.

Preferably, the rotation and tilt element comprises or is operatively arranged to one or more devices or structure providing adjustable elasticity and range for tilting in any direction about said element, and resistance for rotation.

Preferably, the distance from the seat to the rotation and tilt element is in the range 0.25-1.25 m, more preferably 0.3-1.2 m, even more preferably 0.4-1.1 m, even more preferable 0.7-1.1 m, most preferably about 0.8 m.

In a preferable embodiment, the rotation and tilt element comprises a ball structure or a half ball structure in a support, the ball or half ball structure is fixed to or part of the height element, alternatively the ball or half ball structure comprises bolts or similar means for fastening said ball or half ball to the height element at specific or free positions. The height element with ball structure rests, as assembled, in a complimentary ball or half ball shaped seat or support. The ball or half ball is rotatable in the support and tilt able in the support, the support is coupled to the base, the height element comprises a lower part extending downward from the ball structure to a lower end within the base, said lower end is connected to the base with one or more adjustment devices providing adjustment of elasticity or resistance for tilting, adjustment of range of tilting and adjustment for rotation.

As mentioned, the seat is preferably rigidly fastened to an upper end of the height element, the height element is preferably rigid from the seat to the rotation and tilt element. The rotation and tilt element, or more specifically the supporting parts thereof, are preferably rigidly fastened to an upper part or end of the base, except of possible ball bearing, needle bearings or elements movable or slideable by tilting or rotation.

In a preferable embodiment the balance chair comprises a rotation and tilt element comprising a ball bearing or needle bearing arranged to the height element and a support for supporting the height element bearing. Alternatively, a ball shaped or disc shaped protrusion in or on the height element is supported with a correspondingly shaped support seat, the support seat may or may not comprise a ball bearing or needle bearing or the ball- or disc shaped protrusion may or may not comprise a ball bearing or needle bearing.

The rotation and tilt element preferably comprises a separate adjustment device for resistance against rotation.

Preferably, the height element comprises a lower part extending downward from the ball or ball bearing/needle bearing to a lower end within the base. The base comprises one, two, three or more legs, such as five legs, at a lower end, and/or a ring structure and/or a conical structure at a lower end. Preferably, three or more elastic ropes, such as eight ropes, are arranged radially inwards from the legs or ring or similar to a central element that can slide on and be fastened to a lower part of the height element, the position of the central element together with length and elasticity of ropes and central element control elasticity against tilting and optionally range for tilting, the fit between the central element and the lower part of the height element determines or effect rotation resistance. The base or legs extend radially inwards and upwards from the base lower end, coupled to and supporting the supporting seat holding the rotation and tilt element and thereby also the height element with seat on the upper end.

The rotation and tilt element comprises the structure operatively connecting the upper part of the base to the height element and supporting the height element and seat and providing the required tilting and rotation functionality as described.

Preferably, the base comprises structure restricting maximum tilting range, such as a ring structure.

The invention also provides use of a balance chair according to the invention, for one or both of:

training balance and core muscles while sitting, and training balance, technical riding skills and core muscles when simulating riding a horse.

The balance chair of the invention can have numerous embodiments in addition to those described or illustrated in this document. The balance chair of the invention can comprise any features described or illustrated in this document, and equivalents thereto, in any operative combination, and each such operative combination is an embodiment of the balance chair of the present invention.

FIGURES

DETAILED DESCRIPTION

Figure 1:
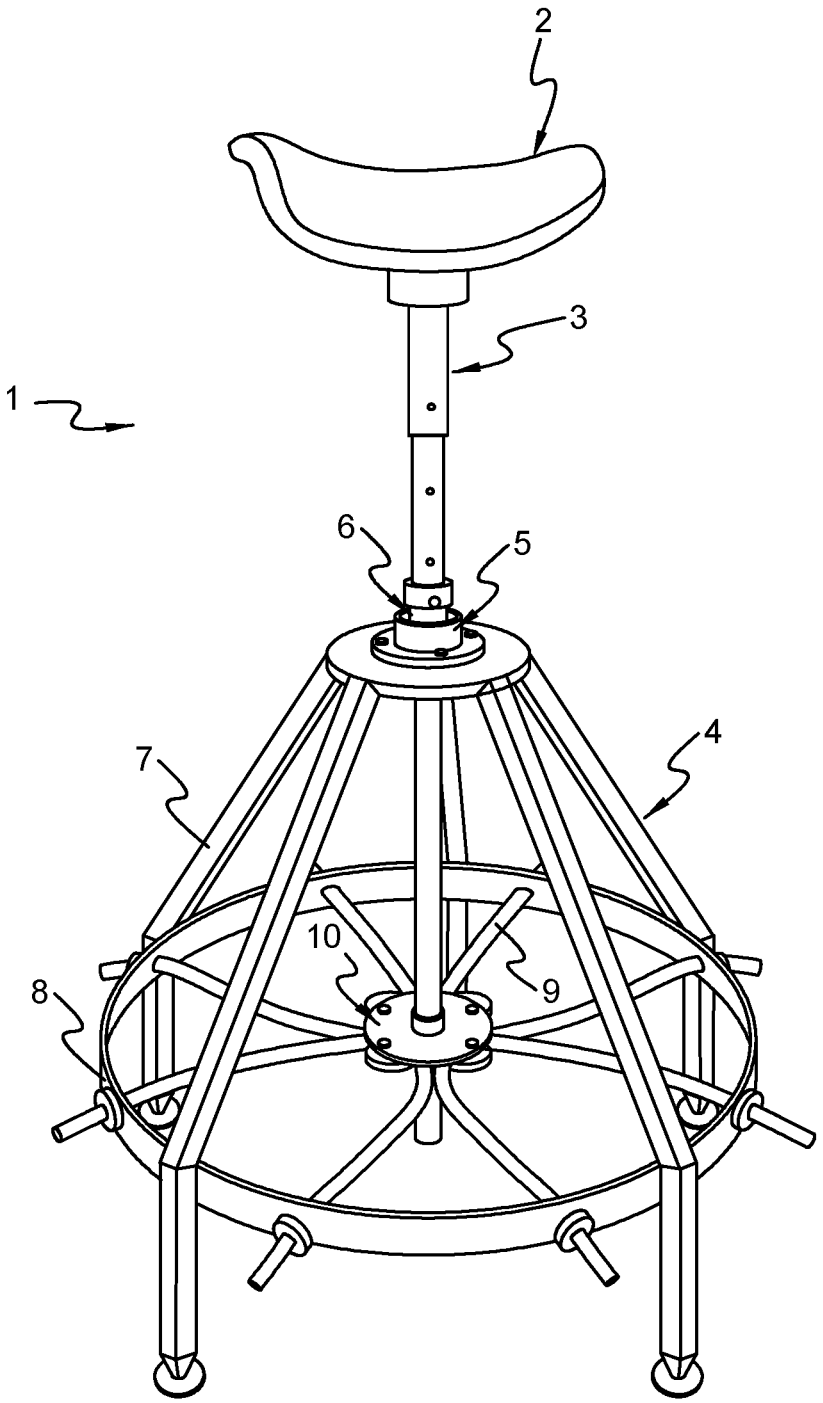
FIG. 1 illustrates an embodiment of the balance chair of the invention.

The embodiment of a balance chair 1 of the invention illustrated in FIG. 1 comprises a seat 2, an in substance vertical height element 3 supporting the seat 2, and a base 4 supporting the height element and seat. The height element 3 comprises a rotation and tilt element 5, arranged in a position in substance midway between the seat and a lower end of the base.

The height element 3 comprises a lower part extending downward from a ball or ball bearing 6 of the rotation and tilt element 5 to a lower end within the base, the base comprises three or more legs 7 and a ring structure 8 at a lower end. Within the base lower end are three or more elastic ropes 9 arranged radially inwards from the legs or ring of the base to a central element 10. Only one of the legs 7 and only one of the ropes 9 has a reference numerical, for clarity. The central element 10 can slide onto and be fastened to the lower part of the height element, the position of the central element together with length and elasticity of ropes and central element governs elasticity against and optionally range for tilting, the fit between central element and the lower part of the height element also can affect rotation resistance. The ropes and the central element, together with possible adjustment devices of the rotation and tilt element, and as working with the lower end of the height element, are examples of adjustment devices providing adjustable elasticity and range for tilting in any direction about said element, and resistance for rotation. The elastic ropes 9 as illustrated, as penetrating the ring structure 8, comprises adjustment or pre-tensioning devices on each rope, on the outside of said ring. The ring structure 8, or similar structure at higher elevation, restrict maximum tilting by stopping the movement of the lower part or end of the height element.

The distance from the seat to the rotation and tilt element is in the range 0.25-1.25 m. Said distance is fixed or can be adjusted with an adjustment element on the height element, for example a telescopic element.

Figure 2:
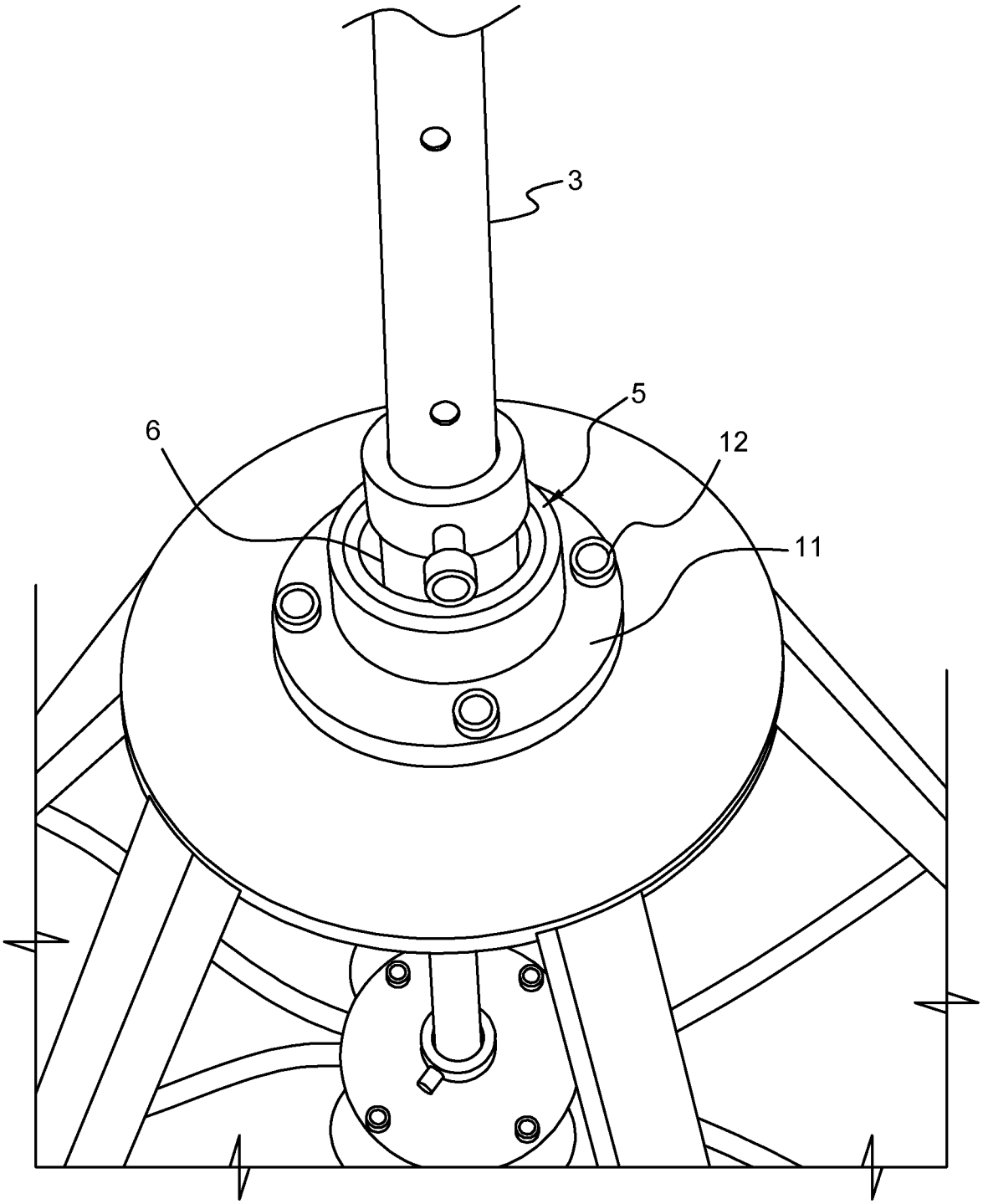
FIG. 2 illustrates details of a balance chair of the invention.

FIG. 2 illustrates the rotation and tilt element 5 as the operative connection between the rigid height element with seat in an upper end, and the base providing a stable foot of the chair. The height element with seat in upper end can rotate around the longitudinal axis of the height element and tilt about the rotation and tilt element. A ball or half ball like structure 6, not clearly visible, rests in a support or seat on top of the base. The ball or half ball like structure is penetrated by the heightength element. Said ball structure is fastened to the support by a flange structure 11, and bolts 12 can be used to adjust or affect the resistance against rotation and tilting, in addition to the adjustment means elastic ropes 9 and central element 10 illustrated in FIG. 1. The half ball like structure is preferably slightly conical on top, facing upwards in a neutral non-tilted orientation, the conical shape restricting the maximum tilting.

The balance chair of the invention provides balance training and training of core muscles, at adjustable precision, level or extent, by adjusting the adjustment devices to fit the purpose or replacing tension or restriction elements. For training of riding skills, the instability is adjustable, the tempo can be from extremely slow to extremely fast. For horse riding training, the level of precision in the training is far above what is achievable with a horse, a large number of repeated training steps can be performed much faster, providing more precise and faster auto-correction-skills for horse riding. These effects for training of horse riding skills have been confirmed unambiguously by test users at different levels. The balance chair of the invention can comprise any feature as here described or illustrated, in any operative combination, and each such operative combination is an embodiment of the balance chair of the invention.

The invention claimed is:

1. A balance chair, comprising:

a seat;

a vertical height element supporting the seat;

a base supporting the vertical height element and the seat, wherein the balance chair comprises a rotation and tilt element arranged in a position between the seat and a lower end of the base from 0.3 to 0.7 times a distance from a top side of a sitting surface face of the seat to the lower end of the base;

wherein the seat is rigidly fastened to an upper end of the vertical height element, the vertical height element is rigid from the seat to the rotation and tilt element;

wherein the vertical height element comprises a lower part extending downward from the rotation and tilt element to a lower end within the base; and wherein springs or elastic ropes are arranged radially inwards from the base to a central element that can slide onto and be fastened to the lower part of the vertical height element.

2. The balance chair according to claim 1, wherein the rotation and tilt element provides 360' rotation around and tilting in any direction about the rotation and tilt element.

3. The balance chair according to claim 2, wherein the rotation and tilt element comprises or is operatively coupled to one or more devices providing elasticity for tilting in any direction about the rotation and tilt element.

4. The balance chair according to claim 1, wherein the rotation and tilt element comprises or is operatively coupled to one or more devices or structure providing adjustable elasticity and range for tilting in any direction about the rotation and tilt element, and resistance for rotation.

5. The balance chair according to claim 1, wherein the distance from the seat to the rotation and tilt element is in the range 0.25-1.25 m.

6. The balance chair according to claim 1, wherein the rotation and tilt element comprises a ball structure in a support, the ball structure is fixed to the vertical height element, the vertical height element with the ball structure in the support is rotatable in the support and tiltable in the support, the support is coupled to the base, the vertical height element comprises a lower part extending downward from the ball structure to a lower end within the base, the lower end is connected to the base with one or more devices providing adjustment of elasticity or resistance for tilting, adjustment of range of tilting and adjustment for rotation.

7. The balance chair according to claim 6, wherein the base comprises three or more legs at at least one of a lower end and a ring structure at the lower end, three or more elastic ropes arranged radially inwards from the three or more legs or the ring structure to a central element that can slide onto and be fastened to the lower part of the vertical height element.

8. The balance chair according to claim 1, wherein the rotation and tilt element and the base comprise at least one of operatively connected springs and elastic ropes.

9. The balance chair according to claim 1, wherein the rotation and tilt element comprises a separate adjustment device for resistance against rotation.

10. The balance chair according to claim 1, wherein the rotation and tilt element comprises a ball bearing or needle bearing coupled to the vertical height element and a seat supporting the vertical height element with the ball bearing or the needle bearing.

* * * * *